US011119446B2

(12) United States Patent
Momose

(10) Patent No.: US 11,119,446 B2
(45) Date of Patent: Sep. 14, 2021

(54) ELECTRONIC TIMEPIECE, MEASUREMENT SYSTEM, AND MEASUREMENT RESULT DISPLAY METHOD

(71) Applicant: SEIKO EPSON CORPORATION, Tokyo (JP)

(72) Inventor: Yasuhiro Momose, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 558 days.

(21) Appl. No.: 15/920,897

(22) Filed: Mar. 14, 2018

(65) Prior Publication Data

US 2018/0275611 A1 Sep. 27, 2018

(30) Foreign Application Priority Data

Mar. 23, 2017 (JP) ..... JP2017-057845

(51) Int. Cl.

| | |
|---|---|
| ***G04B 47/06*** | (2006.01) |
| ***G04G 21/02*** | (2010.01) |
| ***G04G 21/04*** | (2013.01) |
| ***G04B 19/04*** | (2006.01) |
| ***G04B 47/00*** | (2006.01) |

(52) U.S. Cl.

CPC ..... *G04B 47/061* (2013.01); *G04B 47/06* (2013.01); *G04G 21/02* (2013.01); *G04G 21/025* (2013.01); *G04G 21/04* (2013.01); *G04B 19/04* (2013.01); *G04B 47/008* (2013.01)

(58) Field of Classification Search

CPC ..... G04B 47/06–068; G04G 21/02–025

See application file for complete search history.

(56) References Cited

U.S. PATENT DOCUMENTS

| | | | | |
|---|---|---|---|---|
| 2012/0285242 | A1* | 11/2012 | Miyake | G04G 21/02 73/384 |
| 2013/0033970 | A1* | 2/2013 | Miyake | G04C 17/00 368/80 |
| 2014/0176426 | A1 | 6/2014 | Morohoshi | |
| 2015/0085622 | A1* | 3/2015 | Carreel | G04B 47/063 368/10 |
| 2015/0253736 | A1* | 9/2015 | Watterson | G04G 9/0064 368/10 |
| 2015/0335283 | A1 | 11/2015 | Fish et al. | |

(Continued)

FOREIGN PATENT DOCUMENTS

| | | | |
|---|---|---|---|
| CN | 102866622 | A | 1/2013 |
| CN | 104317189 | A | 1/2015 |

(Continued)

*Primary Examiner* — Daniel P Wicklund
(74) *Attorney, Agent, or Firm* — Oliff PLC

(57) ABSTRACT

An electronic timepiece includes: a measurement result obtaining section configured to obtain a measurement result of a display target item which is any measurement item among a plurality of measurement items; a display configured to display the measurement result of the display target item; and a display controller configured to cause the display to display the measurement result of the display target item during a display period that corresponds to the display target item, in which the display period is set in accordance with each of the plurality of measurement items.

11 Claims, 7 Drawing Sheets

(56) References Cited

U.S. PATENT DOCUMENTS

| | | | | |
|---|---|---|---|---|
| 2015/0346843 | A1* | 12/2015 | Piquerez | G04G 21/04 345/156 |
| 2016/0054710 | A1* | 2/2016 | Jo | G04G 9/00 715/763 |
| 2016/0157740 | A1* | 6/2016 | Kampman | G04G 21/025 600/483 |
| 2016/0240149 | A1* | 8/2016 | Kim | G04G 21/02 |
| 2016/0327915 | A1* | 11/2016 | Katzer | G04B 19/04 |
| 2016/0341568 | A1* | 11/2016 | Roush | G04C 3/146 |
| 2018/0181080 | A1* | 6/2018 | Imamura | G04G 99/006 |
| 2019/0307397 | A1* | 10/2019 | Garinaud | G04B 47/063 |

FOREIGN PATENT DOCUMENTS

| | | | |
|---|---|---|---|
| CN | 106413526 | A | 2/2017 |
| JP | H07-27876 | A | 1/1995 |
| JP | H10-132970 | A | 5/1998 |
| JP | 2013-057517 | A | 3/2013 |
| JP | 2014-123169 | A | 7/2014 |
| JP | 2014-169895 | A | 9/2014 |
| JP | 2017-126067 | A | 7/2017 |

* cited by examiner

ELECTRONIC TIMEPIECE, MEASUREMENT SYSTEM, AND MEASUREMENT RESULT DISPLAY METHOD

CROSS-REFERENCE TO RELATED APPLICATION

This application claims priority of Japanese Patent Application No. 2017-057845, filed Mar. 23, 2017, which is expressly incorporated herein by reference thereto in its entirety.

BACKGROUND

1. Technical Field

The present invention relates to an electronic timepiece, a measurement system, and a measurement result display method.

2. Related Art

In the related art, there is known an electronic timepiece that indicates the current time with hour and minute hands, measures a physical quantity, such as a temperature, and indicates the measured physical quantity by an information pointer (for example, refer to JP-A-2013-57517).

The electronic timepiece described in JP-A-2013-57517 includes a temperature sensor for detecting an outside air temperature and a temperature sensor control section for controlling the electric conduction and a measurement period of the temperature sensor to measure the temperature. In the electronic timepiece, the time is indicated by an hour hand and a minute hand which rotate around the center of a dial in the entire dial, and the temperature measured by the temperature sensor is indicated by a short hand positioned in a scale section provided at a 9 o'clock position of the dial.

Here, in an electronic timepiece in which a sensor, such as the electronic timepiece, described in the above-described JP-A-2013-57517, is incorporated, or in an electronic timepiece which communicates with a measuring device that serves as an external device, in terms of power consumption of the entire timepiece, a proportion of power consumption for obtaining the measurement result is relatively large. Therefore, in order to lengthen the driving time of the electronic timepiece, a configuration capable of reducing the power consumption has been demanded.

SUMMARY

An advantage of some aspects of the invention is to provide an electronic timepiece which is capable of reducing power consumption, a measurement system, and a measurement result display method.

An electronic timepiece according to a first aspect of the invention includes: a measurement result obtaining section that obtains a measurement result of a display target item which is any measurement item among a plurality of measurement items; a display section that displays the measurement result of the display target item; and a display control section that causes the display section to display the measurement result of the display target item during a display period that corresponds to the display target item, in which the display period is set in accordance with each of the plurality of measurement items.

According to such a configuration, the display period can be made different depending on the measurement item. Therefore, for example, with respect to the measurement items that can confirm the measurement result only by displaying the measurement result for a short period of time, the power consumption of the electronic timepiece can be suppressed by shortening the display period of the measurement result. Meanwhile, with respect to the measurement items that are necessary for displaying the measurement result for a long period of time, by increasing the display period of the measurement item, it is possible to reliably confirm the measurement result of the measurement item. In addition to this, even in a case where the display period is long, the power consumption can be reduced compared to a case where the measurement result is continuously displayed. Therefore, not only the power consumption of the electronic timepiece can be reduced but also the convenience of the electronic timepiece can be improved.

In the first aspect, it is preferable that the electronic timepiece further includes a measuring section that is capable of measuring at least one measurement item among the plurality of measurement items, and the measurement result obtaining section obtains the measurement result by the measuring section.

With such a configuration, since the electronic timepiece includes the measuring section, the measurement result of the at least one measurement item can be displayed only by the electronic timepiece.

In the first aspect, it is preferable that the electronic timepiece further includes a storage section that stores the display period that corresponds to the measurement item which is measurable by the measuring section among the plurality of measurement items.

According to such a configuration, the storage section stores the display period that corresponds to the measurement item in advance, and accordingly, when displaying the measurement result of the display target item, it is not necessary to obtain the display period from the outside. Therefore, the electronic timepiece can reliably display the measurement result of the display target item only during the display period that corresponds to the display target item.

In the first aspect, it is preferable that the electronic timepiece further includes a communication section that receives a measurement result of the display target item from a measuring device that is capable of measuring at least one measurement item among the plurality of measurement items, and the measurement result obtaining section obtains the measurement result received by the communication section.

Here, in a case where the electronic timepiece is configured to be used while a user wears the electronic timepiece, it is difficult to provide many sensors due to a space in the electronic timepiece, the capacity of the battery, and the weight.

Meanwhile, by allowing the electronic timepiece to communicate with a measuring device that serves as an external device to obtain the measurement result of the at least one measurement item, it is possible to easily increase the measurement item on which the electronic timepiece can display the measurement result. Therefore, it is possible to easily expand the function of the electronic timepiece.

In addition, in such an electronic timepiece, there is no need to incorporate a sensor with large power consumption. Therefore, not only the power consumption of the electronic timepiece can be reduced but also a decrease in size and weight can be achieved.

In the first aspect, it is preferable that the electronic timepiece further includes a display period obtaining section that obtains the display period that corresponds to, among the plurality of measurement items, the measurement item which is measurable by the measuring device from the measuring device.

According to such a configuration, it is not necessary for the electronic timepiece to hold the display period that corresponds to the measurement item that can be measured by the measuring device that is an external device in advance. Therefore, even in a case of obtaining and displaying the measurement result from the measuring device, the electronic timepiece can reliably display the measurement result only during the corresponding display period.

In the first aspect, it is preferable the electronic timepiece further includes a display period setting section that set, in a case where the display target item is changed, the display period that corresponds to the changed display target item to the display period.

According to such a configuration, in a case where the display target item is switched from a measurement item with a long display period to a measurement item with a short display period, it is possible to suppress that the measurement result of the measurement item with a short display period continues to be displayed for a long period of time. In addition, in a case where the display target item is switched from a measurement item with a short display period to a measurement item with a long display period, it is possible to suppress that the measurement result of the measurement item with a long display period is displayed only for a short period of time. Therefore, the convenience of the electronic timepiece can be improved.

In the first aspect, it is preferable that the display section includes a dial, and a pointer which is provided to be rotatable on the dial and indicates the measurement result.

According to such a configuration, since the measurement result is indicated by the pointer, it is possible to intuitively grasp the measurement result. In addition, it is possible to enhance the luxurious feeling of the electronic timepiece compared to a case of digitally displaying such measurement results.

A measurement system according to a second aspect of the invention includes: a measuring device which is capable of measuring a plurality of measurement items; and an electronic timepiece which is configured to be capable of communicating with the measuring device, in which the electronic timepiece includes a measurement result obtaining section that obtains a measurement result of a display target item which is any measurement item among the plurality of measurement items from the measuring device, a display section that displays the measurement result of the display target item, and a display control section that causes the display section to display the measurement result of the display target item during a display period that corresponds to the display target item, and in which the display period is set in accordance with each of the plurality of measurement items.

According to the second aspect, it is possible to achieve similar effects as those of the electronic timepiece according to the first aspect.

A measurement result display method according to a third aspect of the invention is a measurement result display method performed by using an electronic timepiece that displays a measurement result of a display target item which is any measurement item among a plurality of measurement items, the method including: obtaining the measurement result of the display target item; and displaying the measurement result of the display target item during a display period that corresponds to the display target item, in which the display period is set in accordance with each of the plurality of measurement items.

According to the third aspect, by performing the measurement result display method using the electronic timepiece, it is possible to achieve similar effects as those of the electronic timepiece according to the first aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings.

Schematic Configuration of Measurement System

Figure 1:
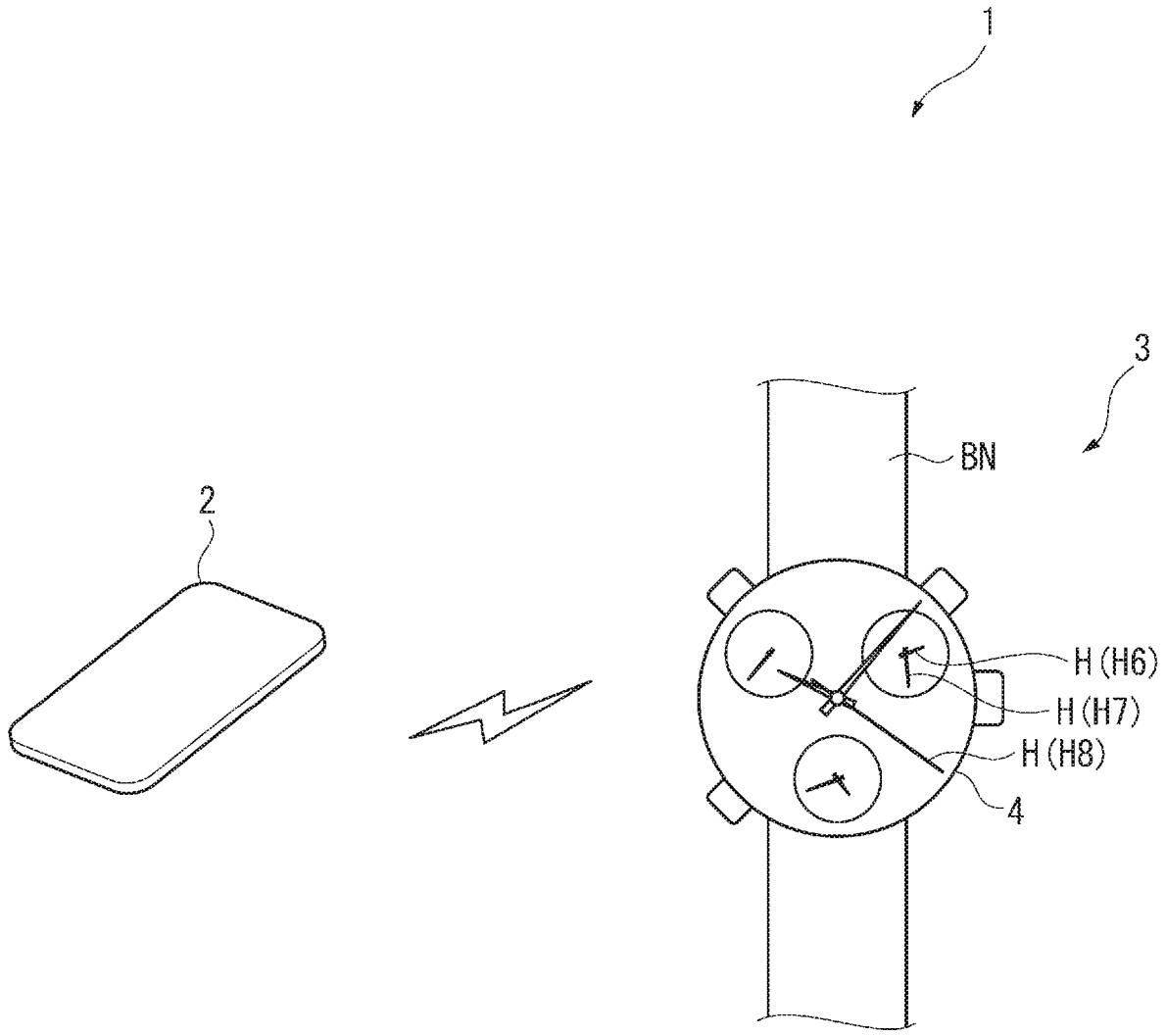
FIG. 1 is a schematic view illustrating a configuration of a measurement system according to an embodiment of the invention.

FIG. 1 is a schematic view illustrating a configuration of a measurement system 1 according to an embodiment.

As illustrated in FIG. 1, the measurement system 1 according to the embodiment includes a measuring device 2 and an electronic timepiece 3 which are configured to be capable of communicating with each other.

The measurement system 1 has one feature that, when the electronic timepiece 3 displays the measurement result measured by a measuring section (measuring instrument) 58 of the electronic timepiece 3 and the measurement result by the measuring device 2, the measurement result (measurement reading) is displayed only during a display period that corresponds to the measurement item (measurement parameter). When the measurement result is displayed, it is a display target item (displayed measurement) among a plurality of measurement items that can be measured by the measuring section 58 and the measuring device 2.

Hereinafter, a configuration of the measuring device 2 and the electronic timepiece 3 (hereinafter, there is a case of being abbreviated as the timepiece 3) will be described in detail.

Configuration of Measuring Device

Figure 2:
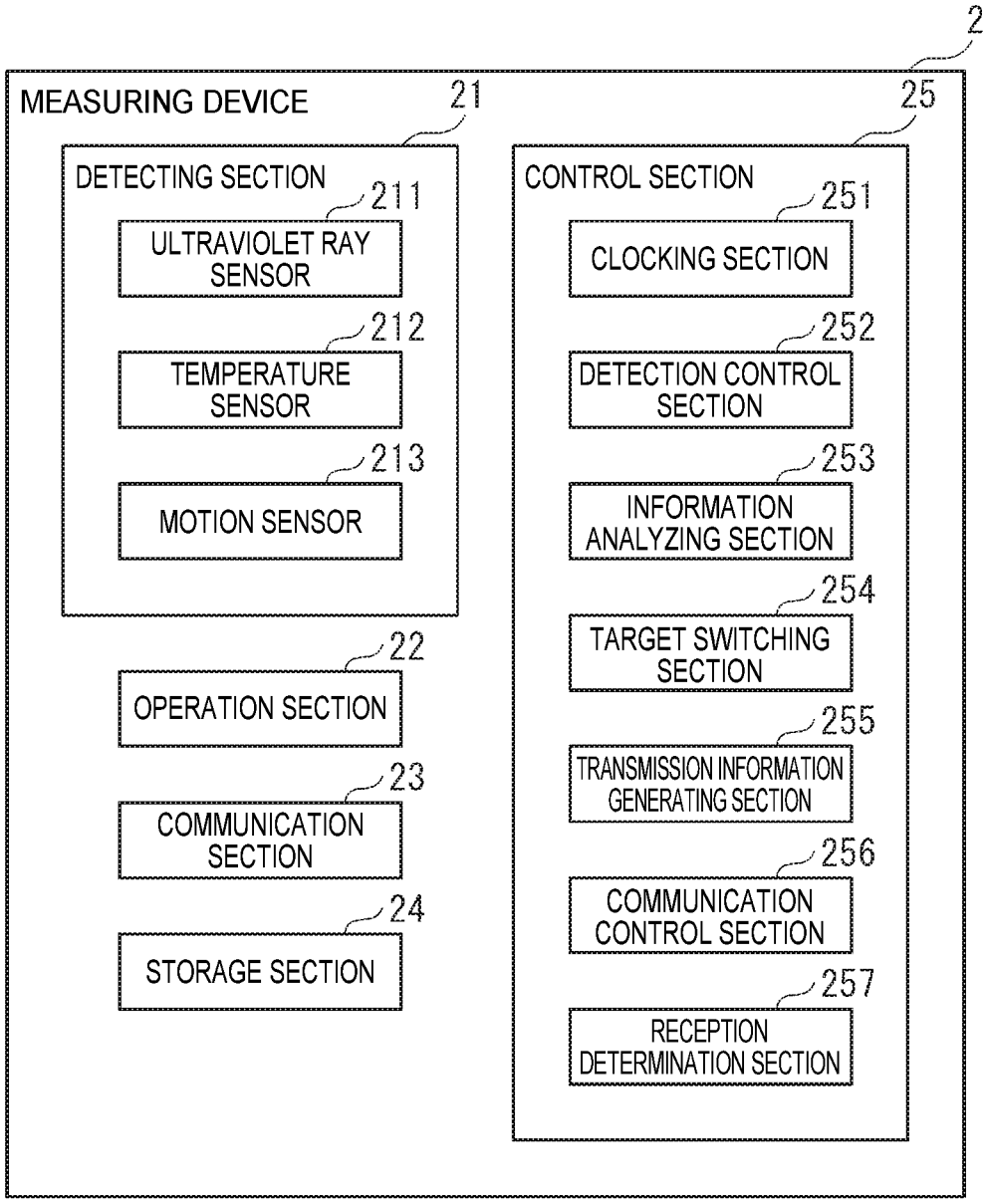
FIG. 2 is a block diagram illustrating a configuration of a measuring device in the embodiment.

FIG. 2 is a block diagram illustrating a configuration of the measuring device 2.

The measuring device 2 is configured to be portable by a user who wears the timepiece 3, and measures various measurement items (for example, measurement items related to the user and measurement items related to the surrounding environment of the measuring device 2). In addition, the measuring device 2 transmits detailed measurement information including the measurement result to the timepiece 3.

As illustrated in FIG. 2, the measuring device 2 includes a detecting section 21, an operation section 22, a communication section 23, a storage section 24, and a control section 25.

Configuration of Detecting Section

The detecting section 21 detects information related to the measurement item. In the embodiment, the detecting section 21 includes an ultraviolet ray sensor 211 that detects the ultraviolet ray amount, a temperature sensor 212 that detects the temperature, and a motion sensor 213 that detects the body motion of the user. In addition, the detecting section 21 outputs a detection signal indicating the detection result of the sensors 211 to 213 to the control section (controller) 25.

In addition, the motion sensor 213 is configured to include at least one of an acceleration sensor and an angular velocity sensor that detects acceleration and angular velocity which act on the measuring device 2.

The detecting section 21 may include another sensor instead of or in addition to at least one of the sensors 211 to 213. As such a sensor, for example, a pulse wave sensor for detecting a pulse wave of the user can be employed.

Configuration of Operation Section

The operation section 22 is a part that receives an input operation to the measuring device 2, and is configured with an input unit, such as a switch provided on the outer surface of the measuring device 2, although not illustrated. As such a switch, the operation section 22 may be, for example, a switch for switching measurement items to which measurement results are transmitted to the timepiece 3. In addition, the operation section 22 outputs an operation signal that corresponds to the input operation, to the control section 25.

Configuration of Communication Section

Under the control of the control section 25, the communication section 23 communicates with the timepiece 3 which is an external device that serves as the measuring device 2. The communication section 23 can be configured with a communication module that can communicate with the timepiece 3 by a communication method that corresponds to a short-distance wireless communication standard, such as IEEE802.15 or a communication method that corresponds to a communication standard, such as IEEE802.16 and long term evolution (LTE). In addition, as the former communication method, Bluetooth (registered trademark) can be employed.

Configuration of Storage Section

The storage section 24 is configured with a nonvolatile memory, such as a flash memory, and stores various programs and data which are necessary for the operation of the measuring device 2. For example, the storage section 24 stores a measurement result transmission program for executing cooperative display processing which will be described later. In addition, the storage section 24 stores the measurement results (measured values) of each of the measurement items.

Furthermore, the storage section 24 stores the period (display period) in which the measurement result is displayed by the timepiece 3 for each of the measurement items. In the embodiment, "1 minute" is stored as a display period of the ultraviolet ray amount, the temperature and the calorie among a plurality of measurement items that can be measured by the measuring device 2, and "60 minutes" is stored as a display period of the number of steps.

Configuration of Control Section

The control section 25 is configured to include an arithmetic processing circuit, such as a central processing unit (CPU), and controls the operation of the entire measuring device 2. The control section 25 includes a clocking section 251, a detection control section (detection controller) 252, an information analyzing section 253, a target switching section 254, a transmission information generation section 255, a communication control section (communication controller) 256, and a reception determination section 257 which respectively have functions by executing the program stored in the storage section 24.

The clocking section 251 clocks the current date and time.

The detection control section 252 controls the operation of the detecting section 21. Specifically, the detection control section 252 makes the sensors 211 to 213 of the detecting section 21 operate at a predetermined sampling rate and outputs the detection signal to the detecting section 21.

The information analyzing section 253 configures the measuring section of the measuring device 2 together with the detecting section 21. The information analyzing section 253 analyzes the detection signal input from the detecting section 21.

For example, the information analyzing section 253 calculates the ultraviolet ray amount based on the detection signal input from the ultraviolet ray sensor 211. In addition, the information analyzing section 253 calculates the temperature (the ambient temperature of the measuring device 2) based on the detection signal input from the temperature sensor 212. Furthermore, the information analyzing section 253 calculates the number of steps on the day and the calorie consumption on the day based on the detection signal input from the motion sensor 213 and the current date and time clocked by the clocking section 251. The measured values (calculated values) are stored in the storage section 24, but the storage section 24 may store each measured value and the date and time at which the detection result that corresponds to the measured value is obtained by making each measured value and the detection result associated with each other.

Among the plurality of measurement items, the target switching section 254 switches a measurement item (a display target item which is a measurement item displayed by the timepiece 3) for transmitting the measurement result to the timepiece 3. Specifically, when an operation signal (switching signal) for switching the measurement item is input from the operation section 22, each time the operation signal is input, the target switching section 254 switches the display target items to one of the ultraviolet ray amount, the temperature, the number of steps, and the calorie, which are the plurality of measurement items, in order.

The transmission information generation section 255 generates transmission information to be transmitted to the external device via the communication section 23. For example, the transmission information generation section 255 generates the detailed measurement information including target item information indicating the display target item, measurement result information indicating a measurement result (measured value) of the display target item, and display period information indicating the display period that corresponds to the display target item. Among these, the display period that corresponds to the display target item is obtained from the storage section 24 and set to the display period information.

Such transmission information is transmitted to the external device (for example, the timepiece 3) by the communication section 23 under the control of the communication control section 256.

The communication control section 256 controls communication with the external device via the communication section 23. When the communication section 23 communicates with the timepiece 3 via Bluetooth, for example, the communication control section 256 stores pairing information obtained from the timepiece 3 in the storage section 24 as connection information. In addition, the communication control section 256 makes the communication section 23 receive various types of information (for example, request information and end information) transmitted from the timepiece 3 for which communication connection has been established based on the connection information, and in addition to this, various types of information (for example, detailed measurement information) are transmitted to the timepiece 3 by the communication section 23.

In a case of communicating with the timepiece 3 via the communication section 23, the reception determination section 257 determines whether or not the request information has been received, and in addition to this, the reception determination section 257 determines whether or not end information which will be described later has been received.

Configuration of Electronic Timepiece

Figure 3:
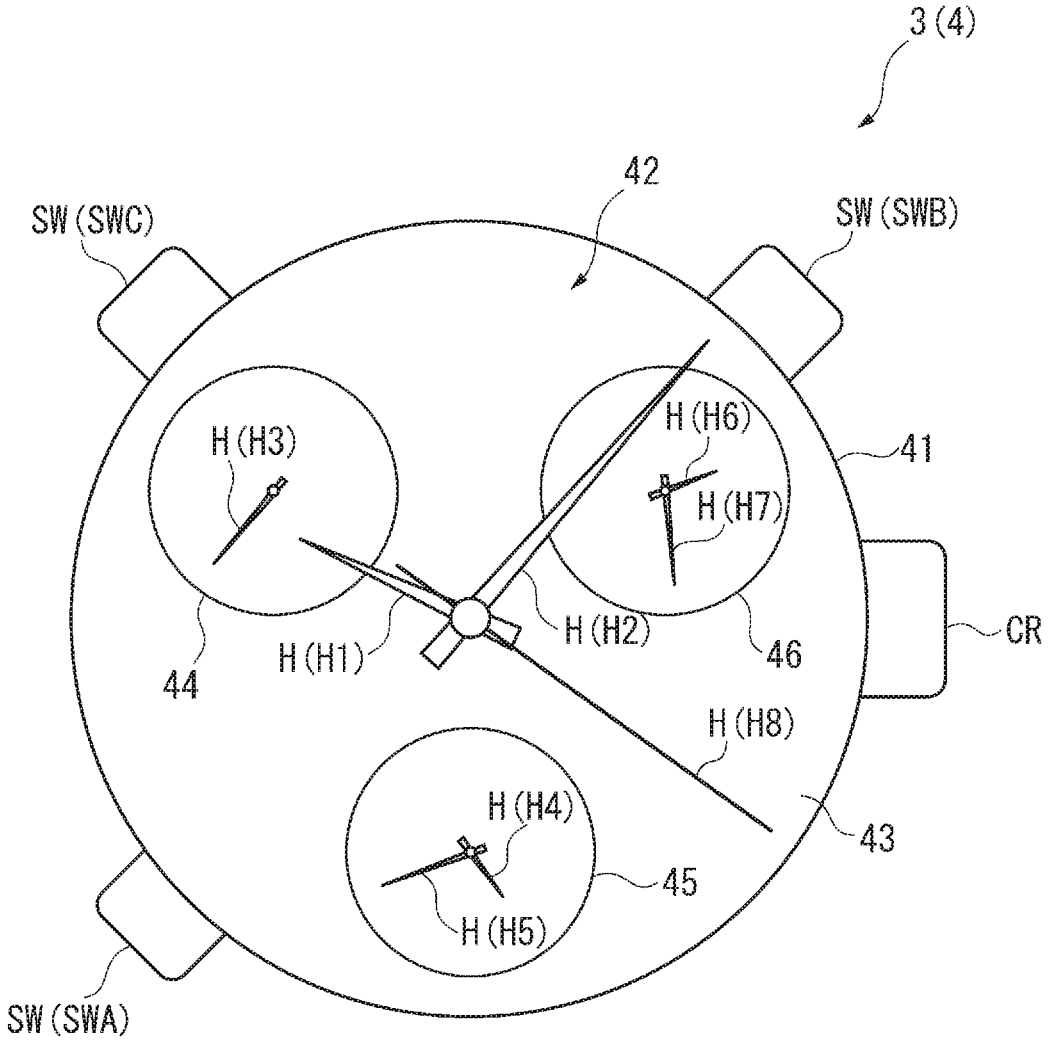
FIG. 3 is a schematic view illustrating an electronic timepiece in the embodiment.

FIG. 3 is a schematic view illustrating the electronic timepiece 3 when viewed from a front side.

The timepiece 3 is a wearable device that is configured to be portable by the user and used while the user wears the timepiece 3. As illustrated in FIG. 3, the timepiece 3 is an analog type electronic timepiece which indicates the current date and time and measurement results of various measurement items by the pointers, which are mechanically-driven. The timepiece 3 includes a timepiece main body 4 and a band BN for allowing the user to wear the timepiece main body 4 on the body (for example, a wrist).

Configuration of Timepiece Main Body

The timepiece main body 4 includes a housing 41 and a display section (display) 42 which are respectively substantially circular when viewed from a front surface.

The housing 41 includes three switches SW (SWA to SWC) that protrude to the side surfaces of each of the housings 41, and one winding knob CR.

The switch SWA is disposed at the position in the substantially 8 o'clock direction, the switch SWB is disposed at the position in the substantially 2 o'clock direction, and the switch SWC is disposed in the substantially 10 o'clock direction, and the switches SWA to SWC configure the operation section that receives an input operation (pressing operation) by the user. The switches SWA to SWC output operation signals that correspond to the input operation, to a control section (controller) 60 (refer to FIG. 4) which will be described later.

The winding knob CR is used when operating the pointer H (for example, an hour hand H1 and a minute hand H2) which will be described later.

The display section 42 includes a dial 43, a plurality of pointers H (the hour hand H1, the minute hand H2, a second hand H3, a mode hand H4, a remaining amount hand H5, and display hands H6 to H8) which are provided to be rotatable on the dial 43.

The dial 43 is formed in a circular shape and is disposed on the front surface of the housing 41. The dial 43 includes three small windows 44 to 46.

In addition, the hour hand H1, the minute hand H2, and the display hand H8 are rotatably provided so that rotation axes of the hands are coaxial substantially at the center of the dial 43.

The small window 44 is positioned in the approximately 10 o'clock direction on the dial 43. In the small window 44, the second hand H3 is disposed to be rotatable.

The small window 45 is positioned in the approximately 6 o'clock direction on the dial 43. In the small window 45, the mode hand H4 and the remaining amount hand H5 are disposed to be rotatable so that rotation axes of the hands are coaxial substantially at the center of the small window 45. Among these, the mode hand H4 is a needle which points the current operation mode of the timepiece 3, and the remaining amount hand H5 is a needle which points the remaining battery level of a secondary battery 53 (refer to FIG. 4) incorporated in the housing 41.

The small window 46 is disposed at a position in the approximately 2 o'clock direction on the dial 43. In the small window 46, the display hands H6 and H7 are disposed to be rotatable so that rotation axes of the hands are coaxial. Among these, the display hand H7 is longer than the display hand H6 and shorter than the display hand H8. In other words, among the display hands H6 to H8, the display hand H8 is the longest and the display hand H6 is the shortest.

In addition, when the timepiece 3 (timepiece main body 4) indicates the measurement result by the measuring section 58 (refer to FIG. 4) which will be described later and the measurement result included in the detailed measurement information received from the measuring device 2, the timepiece 3 (timepiece main body 4) can point a four-digit number by the display hands H6 to H8. In the embodiment, among the four digits, the display hand H6 indicates the numerical value of the first highest digit (for example, the numerical value of digit of thousands) among the four digits, the display hand H7 indicates the numerical value of the second highest digit (for example, the numerical value of digit of hundreds), and the display hand H8 indicates the numerical value of the third highest digit and the fourth highest digit (for example, the numerical value of digit of tens and one). This is also similar in a case where the numerical values below the decimal point are indicated. In other words, during one revolution, the display hands H6 and H7 indicate the value of "0" to "9", and the display hand H8 indicates the value of "00" to "99", respectively.

Internal Configuration of Timepiece

Figure 4:
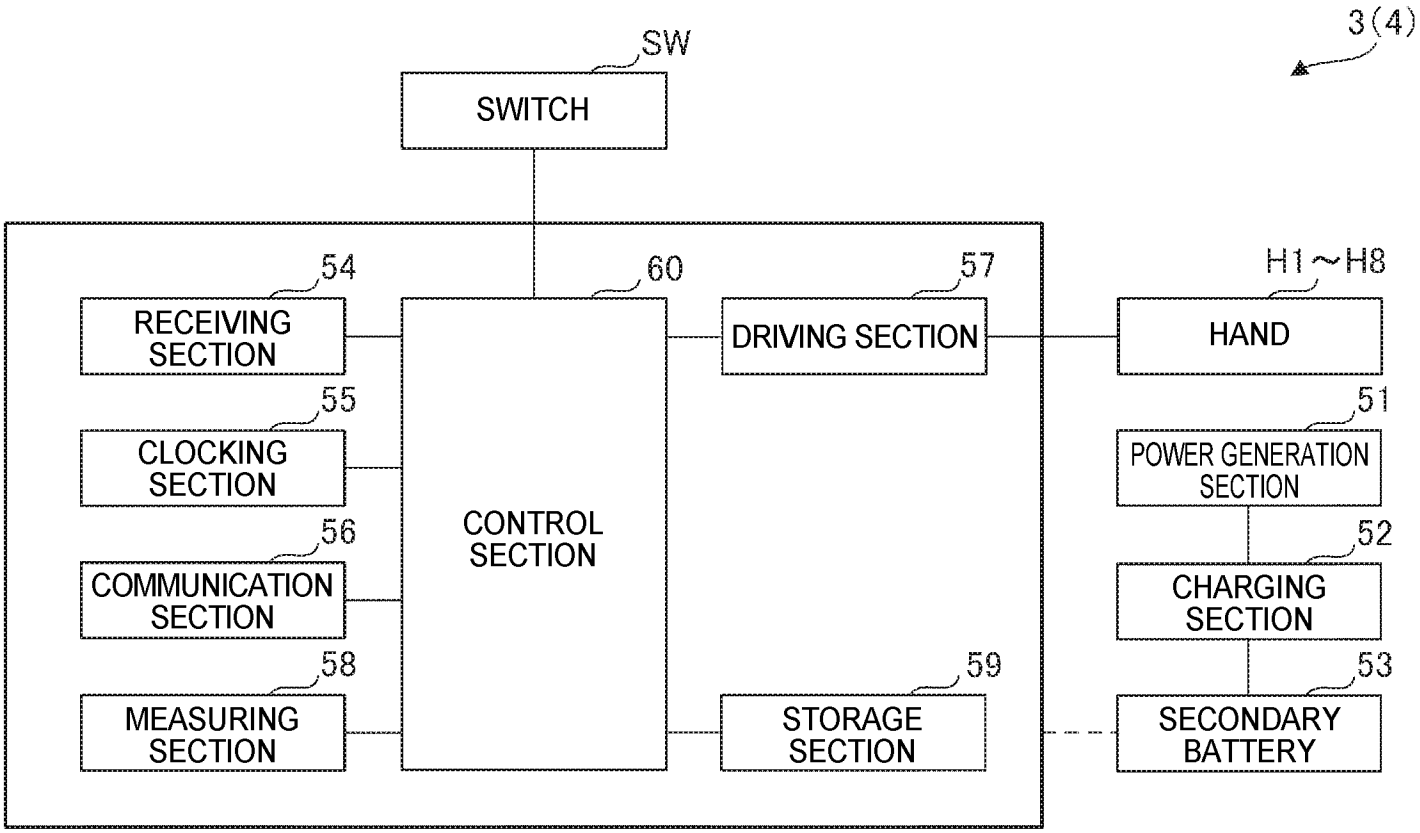
FIG. 4 is a block diagram illustrating an internal configuration of a timepiece main body in the embodiment.

FIG. 4 is a block diagram illustrating an internal configuration of the timepiece main body 4.

In addition to the above-described configuration, as illustrated in FIG. 4, the timepiece main body 4 includes a power generation section 51, a charging section 52, the secondary battery 53, a receiving section 54, a clocking section 55, a communication section (communicator) 56, a driving section 57, a measuring section 58, a storage section (storage medium) 59, and a control section 60, which are provided in the housing 41, respectively.

The power generation section 51 generates the electric power for charging the secondary battery 53. In the embodiment, as the power generation section 51, a solar panel including a plurality of solar cells (photovoltaic elements) for converting light energy into electric energy (electric power) is employed. However, the invention is not limited thereto, and the power generation section 51 may be configured to generate power by rotating a rotary weight.

The charging section 52 charges the secondary battery 53 with the electric power generated by the power generation section 51.

The secondary battery 53 supplies the driving power to the electronic component of the timepiece main body 4. The remaining battery level of the secondary battery 53 is indicated by the remaining amount hand H5.

The receiving section 54 receives satellite signals, such as a global positioning system (GPS) signal, or date and time information included in standard radio waves. The reception of the date and time information by the receiving section 54 is controlled by the control section 60, and is executed, for example, in a case where an operation signal that corresponds to the depression of the switch SWB is inputted or when the time set in advance has come.

The clocking section 55 clocks the current date and time. The current date and time is corrected by the control section 60 which will be described later based on the date and time information received by the receiving section 54.

The communication section 56 communicates with the external device at predetermined time intervals under the control of the control section 60. As a configuration of the communication section 56, a configuration similar to that of the above-mentioned communication section 23 can be exemplified.

The driving section 57 rotates (moves) the pointer H under the control of the control section 60. In the embodiment, the driving section 57 is configured to include a plurality of stepping motors.

Similar to the measuring device 2, the measuring section 58 measures measurement items related to the user or measurement items related to the surrounding environment of the timepiece 3. In the embodiment, the measuring section 58 includes an azimuth sensor for measuring an azimuth and an atmospheric pressure sensor for measuring an atmospheric pressure. In addition, the measuring section 58 calculates the altitude based on the measured atmospheric pressure. In addition, the measuring section 58 outputs the measurement results of the measurement items (azimuth, atmospheric pressure, and altitude) to the control section 60. In addition, the measuring section 58 measures the azimuth, the atmospheric pressure, and the altitude at intervals of 1 second under the control of the control section 60, but the measurement frequency of the measurement items can be appropriately changed, and can also be changed by the control section 60.

In addition, the measuring section 58 may include another sensor for measuring physical quantities of other measurement items instead of or in addition to the azimuth sensor and the atmospheric pressure sensor. For example, in a case where the timepiece 3 does not communicate with the measuring device 2 (in a case where the communication section 56 is not provided), the timepiece 3 may include the sensors 211 to 213 and the information analyzing section 253. In addition, the measuring section 58 may be configured to include a sensor (for example, a pulse wave sensor) for detecting the biological information of the user, or an analyzing section that analyzes the detection result by the sensor.

The storage section 59 is configured to include a non-volatile memory, such as a flash memory, and stores various programs or data which are necessary for the operation of the timepiece 3. For example, the storage section 59 stores a measurement result display program for executing measurement result display processing (single display processing and cooperative display processing which will be described later) executed by the control section 60. In addition, the storage section 59 stores the measurement result by the measuring section 58 and the measurement result by the measuring device 2 in association with the current date and time clocked by the clocking section 55.

Furthermore, similar to the storage section 24, the storage section 59 stores a display time period that corresponds to each of the plurality of measurement items (azimuth, atmospheric pressure, and altitude) that can be measured by the measuring section 58. In the embodiment, "2 minutes" is stored as the display period of azimuth, "1 minute" is stored as the display period of atmospheric pressure, and "2 minutes" is stored as the display period of altitude. However, the invention is not limited thereto, and the display periods can be appropriately changed.

Figure 5:
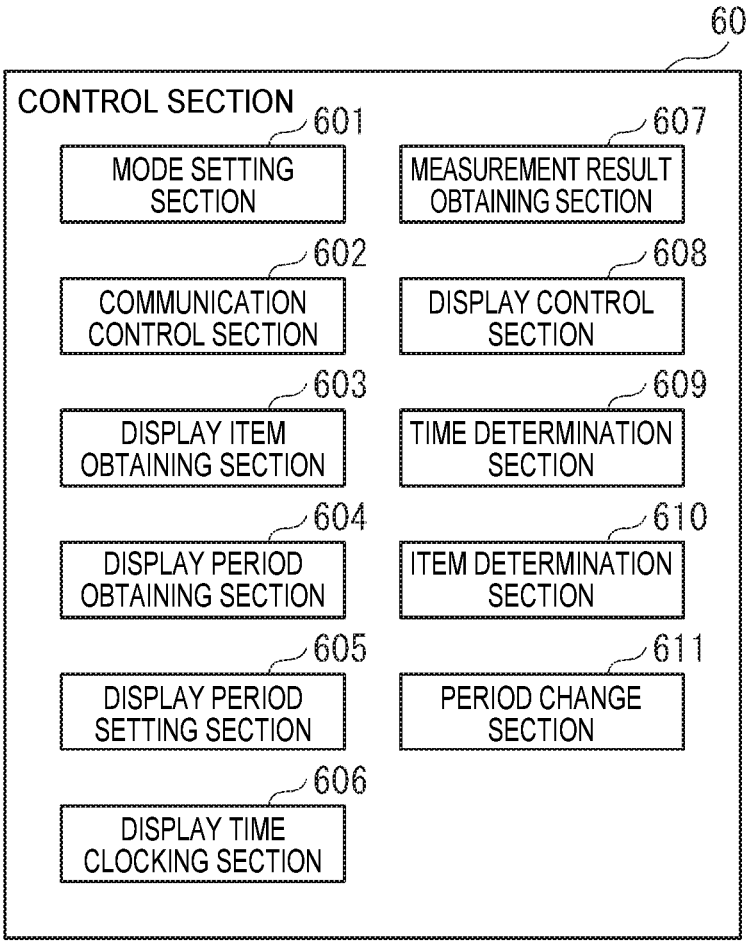
FIG. 5 is a block diagram illustrating a configuration of a control section in the embodiment.

FIG. 5 is a block diagram illustrating a configuration of the control section 60.

The control section 60 is configured to include an arithmetic processing circuit, such as a CPU, and controls the operation of the entire timepiece 3. For example, the control section 60 executes processing that corresponds to an operation signal input corresponding to the depression of the switch SW. In addition to this, the control section 60 makes the receiving section 54 and the clocking section 55 execute the reception of the date and time information and the correction of the current date and time, and makes the driving section 57 to execute the handling of a needle of the pointer H. Furthermore, the control section 60 executes the measurement result display program and executes the measurement result display processing of displaying the obtained measurement result.

In order to execute the processing, as illustrated in FIG. 5, the control section 60 includes a mode setting section 601, a communication control section (communication controller) 602, a display item obtaining section 603, a display period obtaining section 604, a display period setting section 605, a display time clocking section 606, a measurement result obtaining section 607, a display control section 608, a time determination section 609, an item determination section 610, and a period change section 611.

The mode setting section 601 sets the operation mode of the timepiece 3. Specifically, the mode setting section 601 switches the operation mode of the timepiece 3 corresponding to the operation signal when the operation signal that corresponds to the input operation of the switch SWC is input. As the operation mode, a basic mode, an airplane mode, an azimuth display mode, an atmospheric pressure display mode, an altitude display mode, and a communication mode are set in the timepiece 3. In addition, the operation mode set by the mode setting section 601 is indicated by mode hand H4.

The basic mode is a mode which is capable of receiving radio waves including the date and time information or communication waves with the external device, in addition to displaying the current date and time.

The airplane mode is a mode used in a case where the device is in an airplane, and is a mode in which radio wave reception is restricted.

The azimuth display mode is a mode in which the orientation (north direction) based on the detection result of the azimuth sensor is indicated by the display hand H8.

The atmospheric pressure display mode is a mode in which the atmospheric pressure based on the detection result of the atmospheric pressure sensor is indicated by the display hands H6 to H8.

The altitude display mode is a mode in which the altitude calculated based on the atmospheric pressure detected by the atmospheric pressure sensor is indicated by the display hands H6 to H8.

The communication mode is a mode for executing communication with the external device by the communication section 56.

The communication control section 602 controls the communication with the external device by the communication section 56 in a case where the operation mode of the timepiece 3 is the communication mode. For example, in a case where the measurement result by the measuring device 2 is displayed in the timepiece 3, the communication control section 602 transmits the request information for requesting the measurement result (detailed measurement information) to the measuring device 2 by the communication section 56, and in addition to this, the end information for ending the reception of the measurement result is transmitted to the measuring device 2. In addition, the communication control section 602 receives the detailed measurement information transmitted from the measuring device 2 by the communication section 56. In other words, the communication control section 602 can be called a receiving section that receives the detailed measurement information together with the communication section 56. In addition, the communication control section 602 receives the detailed measurement information from the measuring device 2 at predetermined intervals (for example, at intervals of 4 seconds).

In addition, in a case where the communication section 56 communicates with the external device (for example, a smartphone or a personal computer (PC)) different from the measuring device 2, the communication control section 602 can obtain change information for changing the display period that corresponds to an arbitrary measurement item from the external device.

The display item obtaining section 603, the display period obtaining section 604, the display period setting section 605, the display time clocking section 606, the measurement result obtaining section 607, the display control section 608, the time determination section 609, and the item determination section 610 function in a case of displaying the measurement result by the measuring section 58 or the measurement result by the measuring device 2.

The display item obtaining section 603 obtains a measurement item (display target item) which is a display target for displaying the measurement result. For example, in a case where the operation mode of the timepiece 3 is the azimuth display mode, the display item obtaining section 603 obtains the azimuth as the display target item. Similarly, in a case where the operation mode is the atmospheric pressure display mode or the altitude display mode, the display item obtaining section 603 also obtains the atmospheric pressure or the altitude as the display target item. Furthermore, in a case where the operation mode is the communication mode and the measurement result by the measuring device 2 is displayed, the display item obtaining section 603 obtains the display target item indicated by the target item information of the received detailed measurement information.

The display period obtaining section 604 obtains the display period that corresponds to the display target item. Specifically, in a case where any of the plurality of measurement items that can be measured by the measuring section 58 is set as the display target item and the timepiece 3 displays the measurement result by the measuring section 58 (in a case where the operation mode of the timepiece 3 is the azimuth display mode, the atmospheric pressure display mode, or the altitude display mode), the display period obtaining section 604 obtains the display period that corresponds to the display target item from the storage section 59. In addition, in a case where the timepiece 3 displays the measurement result by the measuring device 2, the display period indicated by the display period information of the detailed measurement information is obtained.

The display period setting section 605 sets the display period obtained by the display period obtaining section 604 as a period for displaying the measurement result of the current display target item. In addition, even in a case where the timepiece 3 displays the measurement result by the measuring device 2, in a case where the display period that corresponds to the display target item is stored in storage section 59, the display period stored in advance is set prior to the display period indicated by the display period information of the obtained detailed measurement information.

The display period that corresponds to such a display target item is the maximum display period in which the measurement result of the display target item can be displayed, and may be referred to as a displayable period.

The display time clocking section 606 clocks the elapsed time after the start of the processing of displaying the measurement result of the display target item.

Specifically, in a case where the timepiece 3 displays the measurement result by the measuring section 58, the display time clocking section 606 clocks the elapsed time after the display period (displayable period) that corresponds to the display target item is set.

Meanwhile, in a case of displaying the measurement result by the measuring device 2, the display time clocking section 606 clocks the elapsed time after the display period (displayable period) is set based on the display period information of the detailed measurement information obtained from the measuring device 2.

In addition, the elapsed time clocked by the display time clocking section 606 is reset by the display time clocking section 606 when the display target item is changed.

In the measurement result obtaining section 607, in a case where the timepiece 3 displays the measurement result by the measuring section 58, the measurement result that corresponds to the display target item in the measurement result by the measuring section 58 is obtained. Meanwhile, in a case where the timepiece 3 displays the measurement result by the measuring device 2, the measurement result obtaining section 607 obtains the measurement result indicated by the measurement result information of the detailed measurement information.

The display control section 608 rotates the pointer H by the driving section 57 to display various types of information. For example, the display control section 608 rotates the hour hand H1, the minute hand H2, and the second hand H3 to display the current time clocked by the clocking section 55. In addition, the display control section 608 rotates the mode hand H4 and the remaining amount hand H5 to display the current operation mode of the timepiece 3 and the remaining battery level.

Furthermore, the display control section 608 rotates the display hands H6 to H8 to display the measurement result (measured value) obtained by the measurement result obtaining section 607.

The time determination section 609 determines whether or not the elapsed time clocked by the display time clocking section 606 has passed the display period (displayable period) set by the display period setting section 605. In addition, although will be described later in detail, when the elapsed time passes the display period, the measurement result display processing is ended.

The item determination section 610 determines whether or not the display target item has been changed while the elapsed time has not passed the display period. Specifically, the item determination section 610 determines whether or not the current display target item and the measurement item indicated by the target item information of the newly obtained detailed measurement information match each other. Based on the determination result of the item determination section 610, the display time clocking section 606 determines whether or not to reset the elapsed time.

The period change section 611 changes the display period for each measurement item stored in the storage section 59 based on the change information in a case where the change information is obtained by the communication control section 602.

For example, in a case where the change information is information that sets the altitude display period to "5 minutes", the period change section 611 updates the altitude display period stored in the storage section 59 to "5 minutes".

In addition, for example, in a case where the change information is information that sets the display period of the ultraviolet ray amount which is a measurement item that can be measured by the measuring device 2 as "10 minutes", the information is stored in the storage section 59. Accordingly, as described above, in a case of displaying the ultraviolet ray amount measured by the measuring device 2, the "10 minutes" stored in the storage section 59 as the display period of the ultraviolet ray amount is set by the display period setting section 605 prior to the display period indicated by the display period information of the detailed measurement information.

Measurement Result Display Processing

Next, the measurement result display processing performed by the measurement system 1 will be described.

The measurement result display processing includes the single display processing in which the measurement result by the measuring section 58 is displayed by the timepiece 3 and the cooperative display processing in which the measurement result by the measuring device 2 is displayed by the timepiece 3.

These single display processing and cooperative display processing will be described.

Single Display Processing

Figure 6:
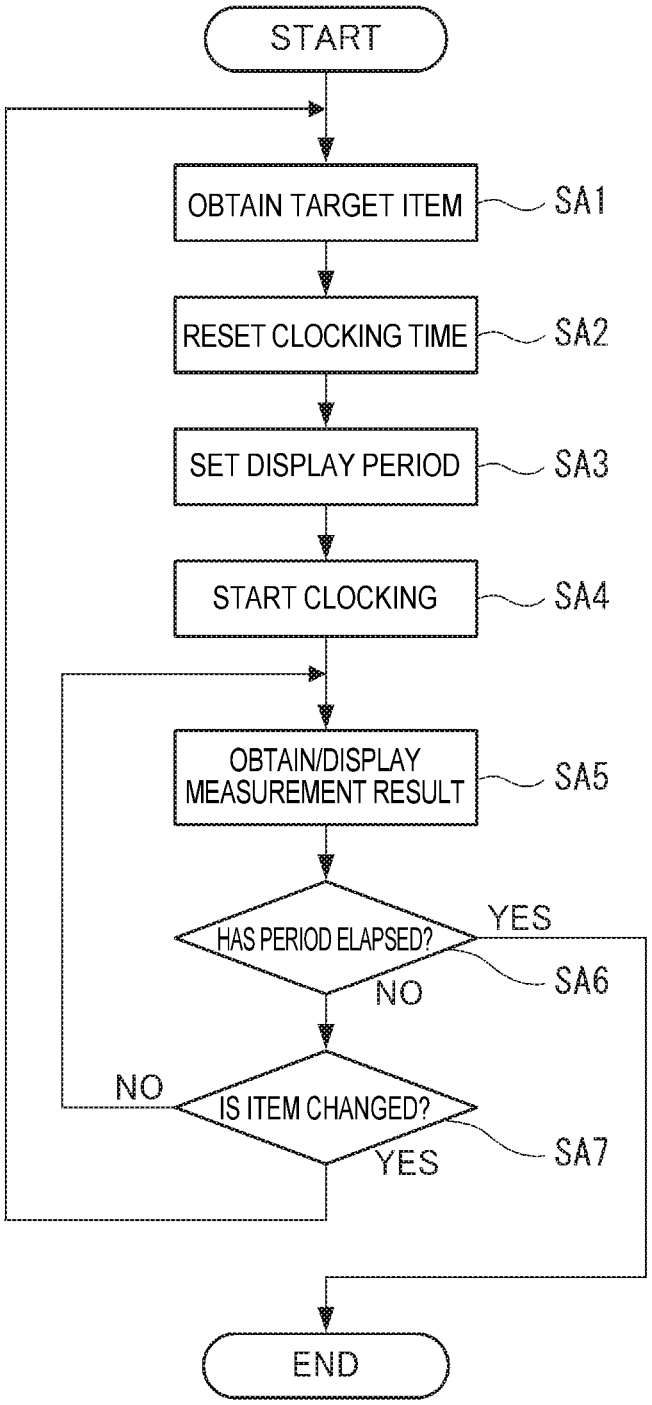
FIG. 6 is a flowchart illustrating single display processing in the embodiment.

FIG. 6 is a flowchart illustrating the single display processing executed by the timepiece 3.

In a case where the operation mode of the timepiece 3 is switched to any of the azimuth display mode, the atmospheric pressure display mode, and the altitude display mode, the control section 60 executes the measurement result display program stored in storage section 59 and executes the following single display processing.

In the single display process, as illustrated in FIG. 6, first, the display item obtaining section 603 obtains the display target item (step SA1).

Next, the display time clocking section 606 resets the elapsed time (time clocked by the display time clocking section 606) (step SA2).

After this, the display period obtaining section 604 obtains the display period that corresponds to the display target item from the storage section 59, and the display period setting section 605 sets the obtained display period as a display period in which the measurement result of the display target item can be displayed (displayable period) (step SA3).

In addition, the display time clocking section 606 starts the clocking of the elapsed time (step SA4).

After this, the measurement result obtaining section 607 obtains the measurement result of the display target item from the measuring section 58, and the display control section 608 displays the measurement result using the display hands H6 to H8 (step SA5).

Meanwhile, the time determination section 609 determines whether or not the elapsed time by the display time clocking section 606 has passed the set display period (displayable period) (step SA6).

By the determination processing in step SA6, when it is determined that the display period has not elapsed (step SA6: NO), the item determination section 610 determines whether or not the operation mode has been changed and the display target item has been changed (step SA7).

By the determination processing of step SA7, when it is determined that the display target item has not been changed (step SA7: NO), the control section 60 returns the processing to step SA5. Accordingly, the measurement result of the display target item is obtained corresponding to the sampling rate of each sensor of the measuring section 58, and the display hands H6 to H8 are rotated to display the measurement result (measured value).

Meanwhile, in the determination processing of step SA7, when it is determined that the display target item has been changed (step SA7: YES), the control section 60 returns the processing to step SA1, and accordingly, the display item obtaining section 603 sets the changed display target item.

In addition, in the determination processing of the step SA6, in a case where it is determined that the elapsed time has passed the display period (displayable period) (step SA6: YES), the control section 60 ends the single display processing.

Accordingly, the measurement results (measured values) of the display target item are indicated by the display hands H6 to H8 until the display period that corresponds to the display target item elapses.

Cooperative Display Processing

Figure 7:
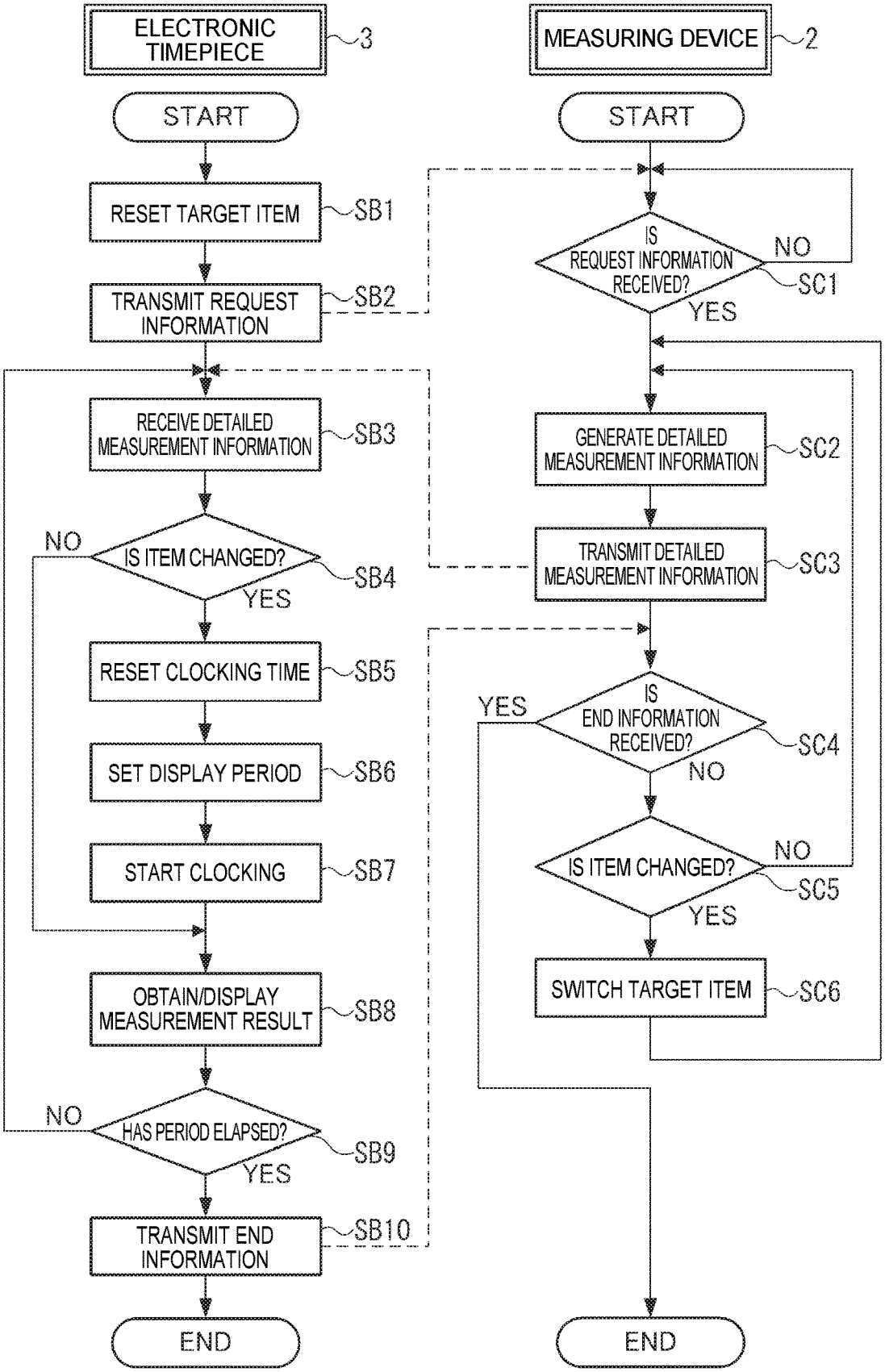
FIG. 7 is a flowchart illustrating cooperative display processing in the embodiment.

FIG. 7 is a flowchart illustrating the cooperative display processing implemented by the measuring device 2 and the timepiece 3.

In a case where the operation mode of the timepiece 3 is the communication mode and the communication connection target is the measuring device 2, the control section 60 executes the measurement result display program stored in the storage section 59, the control section 25 executes the measurement result transmission program stored in the storage section 24, and accordingly, the timepiece 3 and the measuring device 2 execute the following cooperative display processing.

In the cooperative display process, as illustrated in FIG. 7, first, the display item obtaining section 603 resets (initiates) the current display target item (step SB1).

In addition, the communication control section 602 transmits the request information to the measuring device 2 by the communication section 56 (step SB2).

After step SB2, the control section 60 shifts the processing to step SB3.

In the measuring device 2, the reception determination section 257 determines whether or not the request information is received from the timepiece 3 (step SC1). In the determination processing, when the reception determination section 257 determines that the request information has not been received (step SC1: NO), the determination processing is repeatedly executed at predetermined intervals.

Meanwhile, in the determination processing, when the reception determination section 257 determines that the request information has been received (step SC1: YES), the transmission information generation section 255 generates the detailed measurement information (step SC2).

In addition, the communication control section 256 transmits the generated detailed measurement information to the timepiece 3 which is the transmission source of the request information by the communication section 23 (step SC3).

After this, the reception determination section 257 determines whether or not the end information is received from the timepiece 3 (step SC4). In the determination processing, when the reception determination section 257 determines that the end information is not received (step SC4: NO), it is determined whether or not the target switching section 254 has performed an input operation for switching the display target item (step SC5).

In the determination processing of step SC5, when the target switching section 254 determines that the input operation has not been performed (step SC5: NO), the control section 25 returns the processing to step SC2, and the detailed measurement information including new measurement result of the same measurement item is generated and transmitted.

Meanwhile, in the determination processing of step SC5, when the target switching section 254 determines that the input operation has been performed (step SC5: YES), the target switching section 254 switches the display target item to the measurement item that corresponds to the input operation (step SC6).

After this, the control section 25 returns the processing to step SC2. Accordingly, the detailed measurement information including the target item information indicating the new display target item, the measurement result information indicating the measurement result of the display target item, and the display period information indicating the display period that corresponds to the display target item, is generated and transmitted.

In addition, in the determination processing of step SC4, when the reception determination section 257 determines that the end information has been received (step SC4: YES), the control section 25 ends the cooperative display processing at the measuring device 2.

In the timepiece 3 that has shifted to step SB3, the communication control section 602 makes the communication section 56 to receive the detailed measurement information transmitted from the measuring device 2 (step SB3).

After this, the display item obtaining section 603 obtains the target item information from the received detailed measurement information, and the item determination section 610 determines whether or not the display target item has been changed based on the target item information (step SB4). Specifically, in this step SB4, as described above, the item determination section 610 determines whether or not the current display target item (the measurement item indicated by the target item information of the detailed measurement information that has been obtained in advance) and the measurement item indicated by the target item information of the newly obtained detailed measurement information are different from each other.

In addition, in a case where the detailed measurement information is received for the first time after the timepiece 3 transmits the request information, since the display target item has been reset in step SB1, in step SB4, it is determined that the display target item is changed.

By the determination processing of step SB4, when the item determination section 610 determines that the display target item has not been changed (step SB4: NO), the control section 60 shifts the processing to step SB8.

Meanwhile, in the determination processing of step SB4, when the item determination section 610 determines that the display target item has been changed (step SB4: YES), the display time clocking section 606 resets the elapsed time that is currently clocked (step SB5).

In addition, the display period setting section 605 sets the display period that corresponds to the current display target item as the period (displayable period) in which the measurement result is displayed (step SB6). At this time, in a case where the display period that corresponds to the display target item is stored in the storage section 59, the display period setting section 605 obtains and sets the display period, and in a case where the display period is not stored in the storage section 59, the display period setting section 605 sets the display period indicated by the display period information of the newly obtained detailed measurement information.

After this, the display time clocking section 606 starts the clocking of the elapsed time (step SB7).

After step SB7, the control section 60 shifts the processing to step SB8.

In step SB8, the measurement result obtaining section 607 obtains the measurement result information of the obtained detailed measurement information, and the display control section 608 displays the measurement result (measured value) indicated by the measurement result information by the display hands H6 to H8 (step SB8).

In parallel with the step SB8, the time determination section 609 determines whether or not the elapsed time clocked by the display time clocking section 606 has passed the display period (displayable period) set by the display period setting section 605 (step SB9).

In the determination processing of the step SB9, the time determination section 609 determines that the elapsed time has not passed the display period (step SB9: NO), the control section 60 shifts the processing to step SB3. Accordingly, the new detailed measurement information is received in step SB3, and steps SB4 to SB8 are executed based on the detailed measurement information.

Meanwhile, in the determination processing of step SB9, when the time determination section 609 determines that the elapsed time has passed the display period (step SB9: YES), the communication control section 602 transmits the end information to the measuring device 2 (step SB10).

When the step SB10 is executed, the control section 60 ends the cooperative display processing in the timepiece 3.

Effects of Embodiment

According to the measurement system 1 according to the embodiment described above, the following effects can be obtained.

The display period in which the measurement result by the measuring section 58 is displayable by the timepiece 3 and the display period in which the measurement result by the measuring device 2 is displayable by the timepiece 3 are set corresponding to the measurement item. Accordingly, the display period can be made different depending on the measurement item. Therefore, in a case where the measurement item that can confirm the measurement result by the display for a short period of time, such as atmospheric pressure or air temperature, is the display target item, the period in which the measurement result of the display target item is displayed is shortened, and accordingly, the power consumption of the timepiece 3 can be suppressed. Meanwhile, with respect to the measurement item (the measurement items that are necessary for displaying the measurement result for a long period of time) of which the measurement result, such as the number of steps, is desired to be confirmed for a long period of time, by increasing the period in which the measurement result is displayed, it is possible to reliably confirm the measurement result of the measurement item. In addition, even in this case, the power consumption of the timepiece 3 can be suppressed compared to a case where the measurement result is continuously displayed. Therefore, not only the power consumption of the timepiece 3 can be suppressed but also the convenience of the timepiece 3 can be improved.

The timepiece 3 includes the measuring section 58 which is capable of measuring azimuth, atmospheric pressure and altitude. In addition, in a case where the operation mode is switched to the azimuth display mode, the atmospheric pressure display mode, and the altitude display mode, the measurement result obtaining section 607 obtains the measurement result by the measuring section 58. Accordingly, it is possible to display the measurement result of the measurement items by the single timepiece 3 without communicating with the measuring device 2.

The timepiece 3 includes the storage section 59 that stores the display period (displayable period) that corresponds to azimuth, atmospheric pressure and altitude that can be measured by the measuring section 58. According to this, when displaying the measurement result of the display target item, it is not necessary to obtain the display period from the outside. Therefore, the timepiece 3 can reliably display the measurement result of the display target item only during the display period that corresponds to the display target item.

Here, since the timepiece 3 is a wearable device which is used while the user wears the timepiece, it is difficult to provide many sensors due to the space in the timepiece 3 (housing 41), battery capacity and weight.

Meanwhile, the measuring device 2 can measure the ultraviolet ray amount, the air temperature, the number of steps, and the calorie, and the timepiece 3 includes the communication section 56 which is capable of receiving the detailed measurement information including the measurement result of the display target item from the measuring device 2. In addition, in a case of displaying the measurement result, the measurement result obtaining section 607 of the control section 60 obtains the measurement result from the measurement result information of the received detailed measurement information. According to this, it is possible to easily increase the measurement items that can display the measurement result by the timepiece 3. Therefore, it is possible to easily expand the function of the timepiece 3.

In a case where the measurement result by the measuring device 2 is displayed by the timepiece 3, the display period obtaining section 604 obtains the display period (displayable period) of the display target item from the display period information included in the detailed measurement information transmitted from the measuring device 2. According to this, it is not necessary for the timepiece 3 to previously hold the display period that corresponds to the measurement item that can be measured by the measuring device 2. Therefore, even in a case of obtaining and displaying the measurement result from the measuring device 2, the timepiece 3 can reliably display the measurement result of the display target item only during the display period that corresponds to the display target item.

In a case where the display target item is changed, the display period setting section 605 sets the display period that corresponds to the changed display target item as a period in which the measurement result of the display target item can be displayed. Accordingly, in a case where the display target item is switched from a measurement item with a long display period (for example, the number of steps) to a measurement item with a short display period (for example, the temperature), the display period is not changed, and accordingly, it is possible to suppress that the measurement result of the measurement item that can be confirmed for a short period of time continues to be displayed for a long period of time. In addition, in a case where the display target item is switched from a measurement item with a short display period to a measurement item with a long display period, the display period is not changed, and accordingly, it is possible to suppress that the measurement result of the measurement item that is desired to be confirmed for a long period of time is displayed only for a short period of time. Therefore, the convenience of the timepiece 3 can be improved.

The display section 42 of the timepiece 3 includes the dial 43, and the pointers H (display hands H6 to H8) which are provided to be rotatable on the dial 43 and indicate the measurement results of the display target items. Accordingly, it is possible to intuitively grasp the measurement result. In addition, it is possible to enhance the luxurious feeling of the timepiece 3 compared to a case of digitally displaying such measurement results. In addition, compared with the case where such measurement results are digitally displayed, the luxury feeling of timepiece 3 can be enhanced.

Modification of Embodiment

The invention is not limited to the above-described embodiment, and includes variations, improvements and the like within the scope of achieving the advantage of the invention.

In the above-described embodiment, the measuring section 58 of the timepiece 3 is capable of measuring azimuth, atmospheric pressure, and altitude, and the measuring device 2 can measure the ultraviolet ray amount, the temperature, the number of steps, and the calorie. However, the invention is not limited thereto, and the measurement items that can be measured by the measuring section 58 and the measuring device 2 may be other measurement items as described above, and the number of measurement items that can be measured by the measuring section 58 and the measuring device 2 may also be appropriately changed. Meanwhile, when the timepiece 3 can obtain the detailed measurement information from the measuring device 2, the measuring section 58 may be omitted. On the other hand, when the timepiece 3 includes the measuring section 58, the communication between the timepiece 3 and the measuring device 2 is not necessarily required.

In the above-described embodiment, the display period (displayable period) which is a period in which the timepiece 3 can display the measurement results (measured values) of each of the measurement items, is obtained from the storage section 59, and in addition to this, the display period is obtained and set from the detailed measurement information received from the measuring device 2. However, the invention is not limited thereto, and the display period may be stored in the storage section 59 in advance for each of the measurement items that can be displayed by the timepiece 3, including the measurement items that can be measured by the measuring device 2.

In addition, the display period may be input by the user when displaying the measurement result. In addition, in a case where the display target item is changed, the display period is also changed. However, the invention is not limited thereto, in a case where the display target item is changed, the display period may not be changed.

In the above-described embodiment, the timepiece 3 is configured as an analog type electronic timepiece, and the measurement result of the display target item is indicated by the pointer H (display hands H6 to H8), which is mechanically-driven. However, the invention is not limited thereto, and the electronic timepiece may be configured to include a display section that digitally displays the measurement result.

In addition, the number of pointers H for displaying the measurement result may be two or less, or four or more. Furthermore, another pointer H (for example, the hour hand H1, the minute hand H2, and the second hand H3) may be configured to indicate the measurement result. Additionally, the design of the dial 43 (for example the layout of the small window) and the disposition of the pointer H can be appropriately changed.

In the above-described embodiment, the period change section 611 changes the display period of the corresponding measurement item in a case where the change information is received and obtained from the external device. However, not being limited thereto, the period change section 611 may change the display period of the corresponding measurement item corresponding to the input operation on the timepiece 3 of the user. In this case, for example, the display period may be settable by the user, for example, corresponding to the input operation to the winding knob CR.

In the above-described embodiment, the timepiece 3 is configured as a wearable device which is used while the user wears the timepiece. However, not being limited thereto, the electronic timepiece in the invention may be an electronic timepiece disposed at a predetermined position. The measuring device is also similar thereto.

What is claimed is:

1. An electronic timepiece comprising:
a display; and
a processor connected to the display, the processor being configured to:
obtain a first measurement reading of a first measurement parameter measured at a first interval;
cause the display to display the first measurement reading for a first display time period which is stored in a memory and is different from the first interval;
obtain a second measurement reading of a second measurement parameter different from the first measurement parameter, the second measurement parameter being measured at a second interval;
cause the display to display the second measurement reading for a second display time period which is stored in the memory and is different from the second interval;
end display of the first measurement reading when the first display time period has elapsed; and
end display of the second measurement reading when the second display time period has elapsed.

2. The electronic timepiece according to claim 1, further comprising:
a measuring instrument configured to measure the first measurement parameter,
wherein the processor is configured to obtain the first measurement reading by the measuring instrument.

3. The electronic timepiece according to claim 2, wherein the memory is a storage medium in the electronic timepiece.

4. The electronic timepiece according to claim 2, further comprising:
a communicator configured to receive the second measurement reading of the second measurement parameter from a measuring device configured to measure the second measurement parameter,
wherein the processor is configured to obtain the second measurement reading received by the communicator.

5. The electronic timepiece according to claim 4, wherein the processor is further configured to:
obtain the second display time period from the measuring device.

6. The electronic timepiece according to claim 1, further comprising:
a communicator configured to receive the second measurement reading of the second measurement parameter from a measuring device configured to measure the second measurement parameter,
wherein the processor is configured to obtain the second measurement reading received by the communicator.

7. The electronic timepiece according to claim 6, wherein the processor is further configured to:
obtain the second display time period from the measuring device.

8. The electronic timepiece according to claim 1, wherein the display includes:
a dial; and
a pointer rotatable on the dial that indicates the first and second measurement readings.

9. A measurement reading display method performed by using an electronic timepiece configured to display a measurement reading obtained from a sensor of one measurement parameter among a plurality of measurement parameters, the method comprising:
obtaining a first measurement reading of a first measurement parameter measured at a first interval;
displaying the first measurement reading for a first display time period which is stored in a memory and is different from the first interval;
obtaining a second measurement reading of a second measurement parameter different from the first measurement parameter, the second measurement parameter being measured at a second interval;
displaying the second measurement reading for a second display time period which is stored in the memory and is different from the second interval;
ending display of the first measurement reading when the first display time period has elapsed; and
ending display of the second measurement reading when the second display time period has elapsed.

10. A wearable timepiece, comprising:
a display including:
at least one dial having visible digits;
a first mechanically-driven pointer rotatable on the at least one dial; and
a second mechanically-driven pointer rotatable on the at least one dial; and
a processor connected to the display, the processor being configured to:
obtain a first measurement reading of a first measurement parameter measured at a first interval;
cause the display to display the first measurement reading for a first display time period, which is stored in a memory and is different from the first interval, by mechanically driving the first pointer to a first digit of the first measurement reading and mechanically driving the second pointer to a second digit of the first measurement reading;
obtain, from a device separate from the timepiece, a second measurement reading of a second measurement parameter different from the first measurement parameter, the second measurement parameter being measured at a second interval;

cause the display to display the second measurement reading for a second display time period, which is stored in the memory and is different from the second interval, by mechanically driving the first pointer to a first digit of the second measurement reading and mechanically driving the second pointer to a second digit of the second measurement reading;

end display of the first measurement reading when the first display time period has elapsed; and end display of the second measurement reading when the second display time period has elapsed.

11. The wearable timepiece of claim 10, wherein the first measurement reading is a number of steps walked by a wearer of the wearable timepiece.

* * * * *